United States Patent [19]

Sado et al.

[11] 4,145,317

[45] Mar. 20, 1979

[54] PRESSURE-SENSITIVE RESISTANCE ELEMENTS

[75] Inventors: Ryoichi Sado, Saitama; Kazutoki Tahara, Omiya, both of Japan

[73] Assignee: Shin-Etsu Polymer Co., Ltd., Japan

[21] Appl. No.: 854,322

[22] Filed: Nov. 23, 1977

[30] Foreign Application Priority Data

Nov. 29, 1976 [JP] Japan ..... 51-143187

[51] Int. Cl.[2] ..... H01B 1/02

[52] U.S. Cl. ..... 252/512; 252/511; 252/513; 252/514; 252/515; 252/516; 252/518; 338/114

[58] Field of Search ..... 252/512, 511, 513–516, 252/518; 338/114

[56] References Cited

U.S. PATENT DOCUMENTS

| | | | |
|---|---|---|---|
| 3,475,213 | 10/1969 | Stow | 252/512 X |
| 3,767,519 | 10/1973 | Kojima et al. | 252/512 X |
| 4,028,276 | 6/1977 | Harden et al. | 252/516 X |
| 4,054,540 | 10/1977 | Michalchik | 252/512 |

*Primary Examiner*—Benjamin R. Padgett
*Assistant Examiner*—E. Suzanne Parr
*Attorney, Agent, or Firm*—McGlew and Tuttle

[57] ABSTRACT

An improved pressure-sensitive resistance element is provided which is composed of an electrically non-conductive matrix of a rubbery elastomer and electrically conductive particles dispersed therethrough to have a gradient of distribution from one side to the other of the matrix. Such resistance elements can be manufactured by preliminarily mixing a fluid silicone rubber composition with the conductive particles to be uniformly dispersed therein and subsequently subjecting the mixture to curing to form a rubbery elastomer while, concurrently, the particles are naturally or by force allowed to settle to form the gradient of distribution within the matrix.

The resistance elements are superior in easily obtaining the desired resistivity in a wide range by adjusting pressure applied thereto as well as a long service life, compared to products of the kind hitherto known.

7 Claims, No Drawings

PRESSURE-SENSITIVE RESISTANCE ELEMENTS

BACKGROUND OF THE INVENTION

The present invention relates to novel and improved pressure-sensitive electric resistance elements. In particular, the invention relates to novel pressure-sensitive resistance elements that have a very long service life and covers a satisfactorily wide range of resistivity with a relatively low pressure applied thereto.

Pressure-sensitive electric resistance elements composed of a matrix of rubbery elastomer and electrically conductive particles uniformly dispersed therein are known, as disclosed, for example, in U.S. Pat. No. 3,648,002. An improved pressure-sensitive resistance element of such type is disclosed in Japanese Patent Disclosure No. 49-114798 (corresponding to U.S. Pat. application Ser. No. 335,499 filed Feb. 26, 1973, now abandoned), which is composed of a matrix of a rubbery elastomer and electrically conductive particles having an average particle size of 0.1 to 44 μm discretely dispersed in the matrix, the matrix rubber and the conductive particles being separated by the interface layer formed of the incompletely cured matrix rubber or a semiconductive layer of metal soaps.

The pressure-sensitive resistance elements of this type however are poor in durability or service life, because repeated press and release operations lead to worsen its insulation at rest or change the pressure-resistance relationships, resulting in impairing the function of the resistor.

Another type of the pressure-sensitive resistance elements is disclosed in the fortnightly magazine "NIKKEI Electronics," issued Apr. 7, 1965, which are prepared by dispersing a very limited number of spherical particles of nickel having a particular particle size distribution into the matrix of a rubbery elastomer. Despite considerably improved serviceable characteristics, these resistance elements are not recommendable from the standpoint of practicability due to technical difficulties in obtaining the desired resistivity in a stable manner to very delicately adjust the compressive force applied.

The pressure-sensitive resistance elements of the prior art have a satisfactory performance when employed in the on-off operation of an electric circuit. However, they generally encounter difficulties when the resistivity of the element connected within the circuit is to be changed in an intermediate range with stability and reproducibility.

SUMMARY OF THE INVENTION

It is therefore an object of the present invention to provide a novel and improved pressure-sensitive resistance element free from the above described problems in the prior art.

The pressure-sensitive resistance element of the present invention has electrically conductive particles dispersed in the matrix of an electricaly non-conductive rubbery elastomer, the distribution of the conductive particles throughout the matrix varying in a gradient from one side to the other of the matrix, or, in other words, the concentration of the conductive particles in the matrix being high at one side and becoming lower toward the other side, with intermediate concentration in between.

This type of pressure-sensitive resistance element has sufficiently stable and reliable performance when its resistivity is to be varied with stability in a very wide intermediate resistivity range of from an insulating resistance to a metallic conduction.

The serviceable durability is very high even after a long-run of use with repeated compression and release operations, without degraded insulation at normal state and with high stability in the pressure-resistivity relationships. The resistance elements of the present invention are economicaly advantaged by their low production costs.

DETAILED DESCRIPTION OF THE PREFERRED EMBODIMENTS

The matrix of the pressure-sensitive resistance element of the present invention is formed of an electrically non-conductive rubbery elastomer. The material is not limitative in principle, but includes natural and synthetic rubbers, among which silicone rubbers are preferred in consideration of electric properties, stability against heat and aging, and mechanical properties as a rubbery elastomer as well as easiness in fabrication into articles of desired shapes.

A variety of silicone rubbers are known in the art including those curable at room temperature or by heating when classified by curing conditions and those curable by condensation reaction or addition reaction is classified by the mechanisms of crosslink formation.

It is optional that the silicone rubber used as the material of the matrix is admixed with various additives, such as non-conductive fillers and the like. In particular, the incorporation of a reinforcing filler is recommended in order to give excellent mechanical strengths and good durability to the pressure-sensitive resistance elements. Examples of the reinforcing fillers are quarts powders, finely divided silica fillers, e.g. fumed silica and precipitated silica, calcium carbonate, clay, alumina, and magnesia. Other optional additives include coloring agents, e.g. pigments, rust-inhibiting agents, heat stability improvers, anti-static agents, aging retarders, and the like.

The electrically conductive particles to be dispersed in the matrix are formed of various conductive materials, such as, metals and alloys, e.g. gold, silver, platinum, iron, stainless steel, copper, chromium, titanium, tungsten, nickel, cobalt, aluminum, zinc and nichrome; metalloid elements, e.g. silicon and boron; powders of tin(IV) oxide, silver oxide, metal carbonyls, e.g. nickel carbonyl, carbon black, metal carbides, e.g. tungsten carbide, metal whiskers; and finely chopped carbon fibers as well as surface-metallized non-conductive particles.

When the pressure-sensitive resistance element is desired to operate in a resistivity range up to very high conduction, high-conductivity metal particles of, for example, gold, silver, platinum and copper, are preferred, while particles of silicon, boron and carbon black are suitable for a resistivity range up to relatively low conduction. Metal carbonyls and metal carbides are recommended for the intermediate resistivity range.

The size of the electrically conductive particles is preferably in the range from about 0.1 to about 200 μm and, insofar as the particle size is within this range, the shape of the particles is not limitative, including spheres, cubes, pillars, plates, granules, rods, needles, dendrites, sponges, angular ones and irregular chips as obtained when a molten metal is divided by running into water. Among those shaped particles, spheres are suitable when the rubbery matrix before curing has a relatively high viscosity, say, above about 1,000 centipoise, while irregular particles are preferred when the viscosity of the matrix is relatively low, say, so low as 100 centipoise or below, although no critical limitation is given because the viscosity is adjustable by dilution with a solvent. A single shape or a combination of two or more shapes can be used.

The blending proportion of the electrically non-conductive matrix rubber and the electrically conductive particles is determined depending on various factors, such as the kind of the matrix rubber and the shape, density, conductivity and other properties of the electrically conductive particles as well as the desired characteristics of the finished pressure-sensitive resistance element. However, it is usual to use the conductive particles in the range from 5 to 40%, preferably 10 to 35%, by volume based on the whole volume of the matrix with the particles. It is natural that a too large volume of the conductive particles results in an impracticably narrow range of resistivity variations, while a too small volume necessitates a very large compressive force in order to make the resistance element electrically conductive. It is a generally recommendable practice that the formulation of the matrix material and the conductive particles should be determined experimentally in advance so as to achieve a good balance between the compressive force and the desired range of resistivity variations to be obtained by compression.

It is an essential requirement in the present invention that the distribution of the electrically conductive particles in the electrically non-conductive rubbery matrix has a gradient in the direction of compression. The means to produce such gradient distribution of the conductive particles is as follows. An uncured fluid rubber composition is added with a predetermined amount of the conductive particles having an appropriate particle size distribution to form a uniform dispersion, and the resulting blend is shaped by casting in a mold, topping or other suitable means into the desired form, which is then kept standing horizontally or subjected to centrifuge or vibration to cause the sedimentation of the conductive particles within the matrix unevenly in accordance with the particle size distribution, while the cure of the matrix takes place concurrently. It is also possible to accelerate such sedimentation by applying a magnet beneath the blend when the conductive particles are ferromagnetic. Alternatively, shaping and curing of the blend may be carried out in situ on an electrode with which the pressure-sensitive resistance element forms a device having a variable resistor.

Good matching of the sedimentation velocity and the curing velocity is essential in order to obtain the gradient distribution of the particles corresponding to the desired compression-resistivity relationship in the pressure-sensitive resistance element. This requirement can be satisfied by suitable curing temperature, not necessarily an elevated temperature, which is determined depending on various factors, such as the viscosity of the rubber composition, thickness of the shaped body, density and particle size distribution of the electrically conductive particles as well as the desired characteristics of the finished resistance element. Any inclusion of a small amount of bubbles in the shaped body does not rise to any critical problem since, if necessary, the bubbles can be removed by subjecting the shaped body to reduced pressure before curing.

The optimum gradient of the particle distribution in the matrix is set forth in the following manner. The cured body through which the conductive particles have been dispersed and distributed in a gradient concentration is divided into 3 layers, upper, middle and lower, each layer having an equal thickness in the direction of the particle sedimentation. Then, the average content of the conductive particles in each of the upper and lower layers is determined and the difference between the two is expressed by percentages by volume to indicate the gradient. In this case, the optimum is in the range from 1 to 30% by volume, with the limitation that the content of the conductive particles in the upper layer is not lower than 0.02% or preferably, 0.05% by volume in order that the layer is not made intrinsically insulating. When this difference is too small, the distribution of particles approximates to uniformity in distribution exhibiting less advantages of the present invention over the prior art while, on the other hand, a too large difference leads to the eventual formation of a layer in which too small numbers of the conductive particles are dispersed and do not contribute to electrical conduction even with an extremely large compressive force.

The particle size distribution of the conductive particles is particularly important in controlling the gradient of the distribution of the particles in the rubbery matrix. As described hereinbefore, the rubber composition to form the rubbery matrix must be fluid enough to permit the conductive particles to be sedimented. In this respect, organopolysiloxanes as the base component of matrix are suitable since those having viscosities in a very wide range sufficiently low, say, 100 centipoise or lower at 25° C. are readily available.

Silicone rubber compositions curable at room temperature (so-called RTV silicone rubbers) and those curable with heat at a relatively low temperature not higher than 150° C.(so-called LTV silicone rubbers) are especially suitable for the purpose due to their relatively good fluidity. The silicone rubber compositions of these types can make a uniform blend with the electrically conductive particles, e.g. metal particles, and the blend can be shaped into a sheet having an appropriate thickness, which is then kept standing horizontally, optionally under vibration, at room temperature or at an elevated temperature to accelerate curing. In the course that the blend increases its viscosity to final gelation or cure, the conductive particles move downward in different velocities according to their particle sizes and, as a result, the finally cured sheet has the conductive particles distributed in a gradient in the direction of its thickness, viz. in the direction of stress.

As can be observed, the sedimentation of the conductive particles takes place under the mutual influence of neighboring conductive particles, fine and coarse, or under interference with each other, rather than independently and freely, while, as the particles go downward, the liquid rubber matrix under curing is forced to move upward to replace the sinking particles. Thus, a very randomized local distribution of the conductive particles can be produced, which may reflect to beneficial effects to the excellent pressure-sensitive resistance elements of the present invention having a long service life and capable of easily controlling their resistivity within a wide range by applying a relatively small compressive force.

It is optional that the conductive particles are treated in advance with a primer so that better adhesion between the surfaces of the conductive particles and the rubbery matrix is given.

The pressure-sensitive resistance elements of the present invention are utilized in a wide field of applications, for example, as a variable resistor and preset resistor in radio and television sets and audio appliances by being sandwiched between two electrodes, terminal input units and circuit controlling units in teaching machines, telephones, computers, microcomputers and the like, and in the push button units of calculators, registers, telephones, computers and the like by being set on the parallel electrodes of printed circuit boards. Their practical value is very large owing to the simplicity in the manufacturing process and the excellent characteristics or performance in use.

The following examples illustrate the preferred embodiments of the present invention, and should not be construed as limiting the scope of the invention in any way.

EXAMPLE 1.

To 100 parts by weight of a low-temperature curable silicone rubber composition premixed with a curing agent (KE 106LTV, product by Shin-Etsu Chemical Co., Japan, having a viscosity of about 100 centipoise at 25° C.) was added 325 parts by weight of irregularly shaped stainless steel particles having the following particle size distribution, determined by the Tyler Standard Sieve series, the fractions being shown in % by weight.

Coarser than 120 mesh: 0.7%
120 mesh to 150 mesh: 1.1%
150 mesh to 200 mesh: 21.4%
200 mesh to 325 mesh: 29.3%
Finer than 325 mesh: 47.5%

The resulting mixture was mixed uniformly to form a slurry, and the slurry was spread on the roughened surface of a sheet of polytetrafluoroethylene resin to form a thickness of 0.5 mm and kept standing horizontally for 30 minutes at room temperature, then for 30 minutes in an oven at 150° C. to accelerate the curing of the silicone rubber composition.

The cured sheet of the silicone rubber in which the stainless steel particles were dispersed in a gradient distribution was peeled off the sheet of polytetrafluoroethylene resin.

The sheet was cut into 3 equally thick layers along the plane by use of a microtome, and the average contents of the stainless steel powder were determined densitometrically to find that the contents were 27.5% and 30.2% by volume in the upper and lower layers respectively.

Separately, the same sheet was cut to form a test piece of 8 × 8 mm square, which was then sandwiched between two stainless steel electrodes each of 8 mm × 8 mm wide and about 0.5 mm thick. The value of the electric resistance between the electrodes was measured with varied weights to exert compressive force to the test piece. The relationship between the weight and the electric resistance was as follows.

| Weight (per 64 mm$^2$) | Resistance |
|---|---|
| None | Infinity |
| 100 g | about 2 megohm |
| 500 g | about 5 kiloohm |
| 1 kg | about 200 ohm |
| 2 kg | about 3 ohm |

Another similar test piece was placed on a pair of comb-type electrodes with a number of pronged teeth, planely combined so as to have a tooth of one electrode positioned between two teeth of the other electrode, each tooth being formed of gold-plated copper sheeting 0.05 mm thick, with a gap formed between the two opposing teeth being 0.3 mm wide and 5 mm long, so that the layer richer in the stainless steel particles come into contact with each electrode. The test piece was then pressed from the upper surface by a round-tipped rod of 5 mm in diameter with a cycle of force of 100 g and 1 kg. After about 50,000 cycles of continued pressing, the initial relationship between the pressing force and the resistance became destroyed, when about 500 ohm of the resistance was indicated with the pressing force of 100 g, compared to the initial value of about 1 megohm.

For purposes of comparison, a commercially available pressure-sensitive element (DYNACON C, product of Dynacon Industries Inc., U.S.A.) in the form of a 0.5 mm thick sheet, in which the contents of the conductive metal particles in each of the two outer layers out of three layers evenly cut by use of a microtome had a difference of less than 0.2% by volume, was tested in the same manner as above, using a similar rod to find that the initial relationship between the pressing force and the resistance became destroyed after about 10,000 pressing cycles, indicating a resistance of about 500 ohm with the pressing force of 100 g, compared to the initial value of about 1 megohm.

EXAMPLE 2

To 100 parts by weight of the same low-temperature curable silicone rubber composition premixed with the same curing agent as used in Example 1 was added 280 parts by weight of a dendritic particles of stainless steel finer than 100 mesh (Tyler Standard) to form a slurry. The slurry was treated in order to form a silicone rubber composition in the same manner as in Example 1 except the polytetrafluoroethylene sheet used was 1.0 mm thick, instead of 0.5 mm thick. From the thus obtained silicone composition, a cured sheet in which stainless steel particles were dispersed was formed and subjected to the determination of the contents of the stainless steel particles in the upper and lower layers in the same manner as in Example 1. The results indicated 23.0% and 27.9% by volume, respectively.

Then, a test piece was prepared in the same manner as in Example 1, and then subjected to a test, using similar comb-type electrodes and a rod 5 mm in diameter, to determine electric resistance between the electrodes and the rod. The results were 100 kiloohm with a pressing force of 100 g and 60 ohm with a pressing force of 2 kg.

EXAMPLE 3

Into 120 parts by weight of a polyurethane sealing material prepared by mixing 80 parts by weight of Coronate L (product of Nippon Urethane Co., Japan) and 40 parts by weight of polyethyleneglycol (D-2000, product of Nippon Oils and Fats Co., Japan) was added 100 parts by weight of nickel particles finer than 325 mesh having a spherical shape with the skelton structure to form a uniform blend. The blend was shaped into a sheet 0.5 mm thick, which was then subjected to curing with heat at 50° C. for 30 minutes while, concurrently, the nickel particles allowed to settle. The resultant cured sheet was cut into 3 layers of equal thicknesses by use of a microtome to determine the contents of the nickel particles in the upper and lower layers, which were found to be 6% and 14% by volume, respectively.

The compressive force vs. resistivity relationship was determined in the same manner as in Example 1 by sandwiching a 2 × 2 mm test piece with electrodes. The results were about 800 kiloohm with 1 kg of weight and about 600 kiloohm with 2 kg of weight.

What is claimed is:

1. A pressure-sensitive resistance element which comprises a matrix of an electrically non-conductive rubbery elastomer and electrically conductive particles mixed with said matrix in an amount ranging from about 5 to about 40% by volume based on the whole volume of said matrix, said conductive particles being dispersed through said matrix, with a distribution varying in a gradient from one side to the other of the matrix in such a manner that the difference in the average contents of the conductive particles in the two outer layers of three layers of an equal thickness formed by dividing the element with planes perpendicular to the direction of the gradient of distribution is in the range from about 1 to about 30% by volume.

2. The pressure-sensitive resistance element described in claim 1, wherein the electrically non-conductive rubbery elastomer is a silicone rubber.

3. The pressure-sensitive resistance element described in claim 1 wherein the electrically conductive particles have a particle size distribution in the range of from about 0.1 to about 200 μm .

4. The pressure-sensitive resistance element described in claim 1, wherein the conductive particles in the matrix are in the range from about 10 to about 35% by volume based on the whole volume of said matrix with said particles.

5. The pressure-sensitive resistance element described in claim 1 wherein the electrically conductive particles are particles of a metal.

6. Method for the preparation of the pressure-sensitive resistance element described in claim 1 comprising the steps of (a) mixing the electrically conductive particles uniformly with an electrically non-conductive rubbery elastomer composition to form a uniform blend and (b) subjecting the blend to the curing of the rubbery elastomer composition with concurrent sedimentation of the electrically conductive particles.

7. The method described in claim 6, wherein the electrically non-conductive rubbery elastomer composition is a thermally curable silicone rubber composition.

* * * * *